US008268736B2

(12) United States Patent
Varga-Molnar et al.

(10) Patent No.: US 8,268,736 B2
(45) Date of Patent: Sep. 18, 2012

(54) PROCESS FOR IMPROVING THE BREAKING STRENGTH AND/OR TEAR STRENGTH OF ADSORPTIVE FILTERING MATERIALS

(75) Inventors: Anna Varga-Molnar, Mönchengladbach (DE); Hanno Oppermann, Rheine (DE)

(73) Assignee: Blucher GmbH, Erkrath (DE)

( * ) Notice: Subject to any disclaimer, the term of this patent is extended or adjusted under 35 U.S.C. 154(b) by 0 days.

(21) Appl. No.: 11/500,700

(22) Filed: Aug. 8, 2006

(65) Prior Publication Data

US 2010/0224552 A1 Sep. 9, 2010

(30) Foreign Application Priority Data

Aug. 10, 2005 (DE) ..... 10 2005 038 098

(51) Int. Cl.

| | |
|---|---|
| ***B32B 5/26*** | (2006.01) |
| ***B32B 27/14*** | (2006.01) |
| ***B32B 27/04*** | (2006.01) |
| ***B32B 3/10*** | (2006.01) |
| ***D04B 21/20*** | (2006.01) |
| ***D04B 7/14*** | (2006.01) |

(52) U.S. Cl. ..... 442/121; 442/312; 442/319; 428/195.1; 428/197

(58) Field of Classification Search ..... 442/121, 442/308, 313, 314, 319, 417; 428/175, 195.1, 428/197, 198, 201, 206; 66/182, 190
See application file for complete search history.

(56) References Cited

U.S. PATENT DOCUMENTS 4,455,187 A * 6/1984 von Blucher et al. ..... 156/277

(Continued)

FOREIGN PATENT DOCUMENTS

DE 1 950 701 U 9/1966

(Continued)

OTHER PUBLICATIONS

McCullough et al. "A comparison of standard methods for measuring water vapour permeability of fabrics" in *Meas. Sci. Technology* [Measurements Science and Technology] 14, 1402-1408, Aug. 2003, pp. 1402-1408.

(Continued)

*Primary Examiner* — Jennifer A Steele
(74) *Attorney, Agent, or Firm* — Woodard Emhardt Moriarty McNett & Henry LLP

(57) ABSTRACT

The present invention relates to a process for improving the breaking strength and/or tear strength of a warp-knitted fabric, in particular for use in adsorptive filtering materials having a protective function against chemical poisons and/or warfare agent materials, the process comprising providing the warp-knitted fabric with a multiplicity of wales, a multiplicity of courses and a multiplicity of structural elements. In accordance with the present invention, a portion of the structural elements is configured as to each extend over a plurality of wales, so that in the event of a breaking stress on the warp-knitted fabric or the action of a breaking force the structural elements which each extend over a plurality of wales are pushed together or bundled and an improved breaking force results.

6 Claims, 7 Drawing Sheets

U.S. PATENT DOCUMENTS

| | | | | | |
|---|---|---|---|---|---|
| 4,500,581 | A | * | 2/1985 | Mitomi et al. | 428/85 |
| 4,567,075 | A | * | 1/1986 | Krawczyk | 428/91 |
| 5,190,806 | A | * | 3/1993 | Nomi | 428/198 |
| 5,334,436 | A | * | 8/1994 | Hobbs et al. | 428/195.1 |
| 5,350,443 | A | * | 9/1994 | von Blucher et al. | 96/135 |
| 5,731,035 | A | | 3/1998 | Stelzmüller et al. | 428/198 |
| 6,281,150 | B1 | * | 8/2001 | Groshens | 442/314 |
| 7,465,490 | B2 | * | 12/2008 | Von Blucher | 428/316.6 |
| 2003/0056552 | A1 | | 3/2003 | Englebert, Sr. et al. | 66/170 |

FOREIGN PATENT DOCUMENTS

| | | | | |
|---|---|---|---|---|
| DE | 694 70 173 | U | | 12/1969 |
| DE | 32 10 070 | A1 | | 11/1982 |
| DE | 19849395 | | * | 5/2000 |
| DE | 203 06 251 | U1 | | 6/2004 |
| GB | 1 203 293 | | | 8/1970 |
| GB | 2 055 407 | A | | 3/1981 |
| WO | WO 94/01198 | | | 1/1994 |

OTHER PUBLICATIONS

Din En 31 092: 1993 of Feb. 1994 ("Textiles—Physiological Effects, Measurement of Heat and Water Vapor Transmission Resistance under steady state Conditions [sweating guarded-hotplate test]", 9 pgs.

European Search Report dated Nov. 30, 2006 from EP 06 01 4664.

* cited by examiner

PROCESS FOR IMPROVING THE BREAKING STRENGTH AND/OR TEAR STRENGTH OF ADSORPTIVE FILTERING MATERIALS

CROSS-REFERENCES TO RELATED APPLICATIONS

This application claims priority to German Patent Application No. DE 10 2005 038 098.0, filed Aug. 10, 2005, entitled "PROCESS FOR IMPROVING THE BREAKING STRENGTH AND/OR TEAR STRENGTH OF ADSORPTIVE FILTERING MATERIALS". This reference is expressly incorporated by reference herein, in its entirety.

BACKGROUND OF THE INVENTION

The present invention relates to a process for improving or enhancing the breaking strength and/or tear strength of a warp-knitted fabric as may be used in particular in adsorptive filtering materials having a protective function against chemical poisonous and/or warfare agent materials. The present invention further relates to the use of floats for improving or enhancing the breaking strength and/or tear strength of such a warp-knitted fabric. The present invention finally relates to an adsorptive filtering material having a protective function against chemical poisonous and/or warfare agent materials which is configured on the basis of a warp-knitted fabric having improved breaking strength and/or tear strength as a backing material.

There are a whole series of materials that are absorbed by the skin and lead to serious physical noxae (harm). Examples include chemical warfare agents, such as the versicatory mustard gas Yellow Cross (Hd) and the nerve gas sarin. People likely to come into contact with such poisons must wear a suitable protective outfit and/or be protected against these poisons by suitable protective materials.

Appropriate protective suits are available to protect the body, especially the extremities and the trunk. Protective suits against chemical poisons that are intended for prolonged deployment under a wide variety of conditions must not lead to heat build-up for the wearer. Air-pervious materials are therefore used in the main. Air-pervious, permeable protective suits generally possess an adsorptive layer comprising activated carbon to bind chemical poisons very durably, so that there is no danger for the wearer emanating even from badly contaminated suits.

Such protective suits shall not impair the user's freedom of movement and protect the wearer securely against any chemical exposure for a defined period. The adsorption-capable material in such protective suits is frequently a spherical adsorbent, such as activated carbon, the spherical adsorbent being bonded in sheetlike form, for example by means of an adhesive, to a textile sheetlike material serving as a backing material. Textile fabrics are often used as textile backings in prior art protective suit manufacture.

A further important requirement of such protective suits is strength on the part of the protective suit or part of the textile fabric used as a backing material. This is because any damage to the protective suit or to the textile sheetlike material used will inevitably lead to a point of entry for chemical poisons and/or warfare agent materials, so that the protective suit itself can be deprived of its protective performance by minor damage. Therefore, the choice of textile backing material plays an important part with regard to the stability of protective suits produced therefrom. The textile backing material should possess high mechanical stability and more particularly withstand even severe mechanical loading, such as high breaking and tearing forces of the kind encountered in military deployments for example.

Prior art protective suits, which frequently comprise simple textile wovens as textile backing material for the adsorbents, are often unable to meet these high requirements with regard to mechanical stability, in particular with regard to their breaking and/or tearing behavior, so that prior art protective suits do not always ensure optimal protection against chemical poisons and/or warfare agent materials under extreme conditions in particular, for example when the soldier or wearer is in a battle scenario, since the protective suit can suffer damage under this stress in that it can tear in particular.

Similarly, the need for protective suits to meet the requirements of a long wearing period and an attendant washability immediately results in the need for textile backing materials possessing high mechanical strength.

As well as the military deploying protective suits, in particular for protection against chemical warfare agents, such as NBC warfare agents, the chemical industry also utilizes protective suits, for example to protect against toxic gases of the kind generated in numerous manufacturing operations. For this reason, the employees in question and also members of the fire service or of disaster control taskforce have to be equipped with specific protective suits to be safe during their deployment. In the event of any deployment, the protective suit is temporarily exposed to extreme physical and mechanical stresses which it must withstand without loss of its protective functions in order that the risk of contamination may be minimized.

Against this technical background, then, the present invention has for its object to provide an adsorptive filtering material having a protective function against chemical poisonous and/or warfare agent materials which is suitable for producing protective suits and at least essentially obviates or alternatively at least ameliorates the above-described disadvantages of the prior art.

BRIEF SUMMARY OF THE INVENTION

A process for improving the breaking strength and/or tear strength of a warp-knitted fabric, in particular for use in adsorptive filtering materials having a protective function against chemical poisons and/or warfare agent materials, the process comprising providing the warp-knitted fabric with a multiplicity of wales, a multiplicity of courses and a multiplicity of structural elements, wherein a portion of the structural elements is configured or arranged to each extend over a plurality of wales.

The present invention has for its object in particular to provide a process for improving the breaking strength and/or tear strength of a warp-knitted fabric which can be used in particular as a textile backing material in an adsorptive filtering material having a protective function against chemical poisons and/or warfare materials.

Related objects and advantages of the present invention will be apparent from the following description.

DETAILED DESCRIPTION OF THE INVENTION

Figure 1:
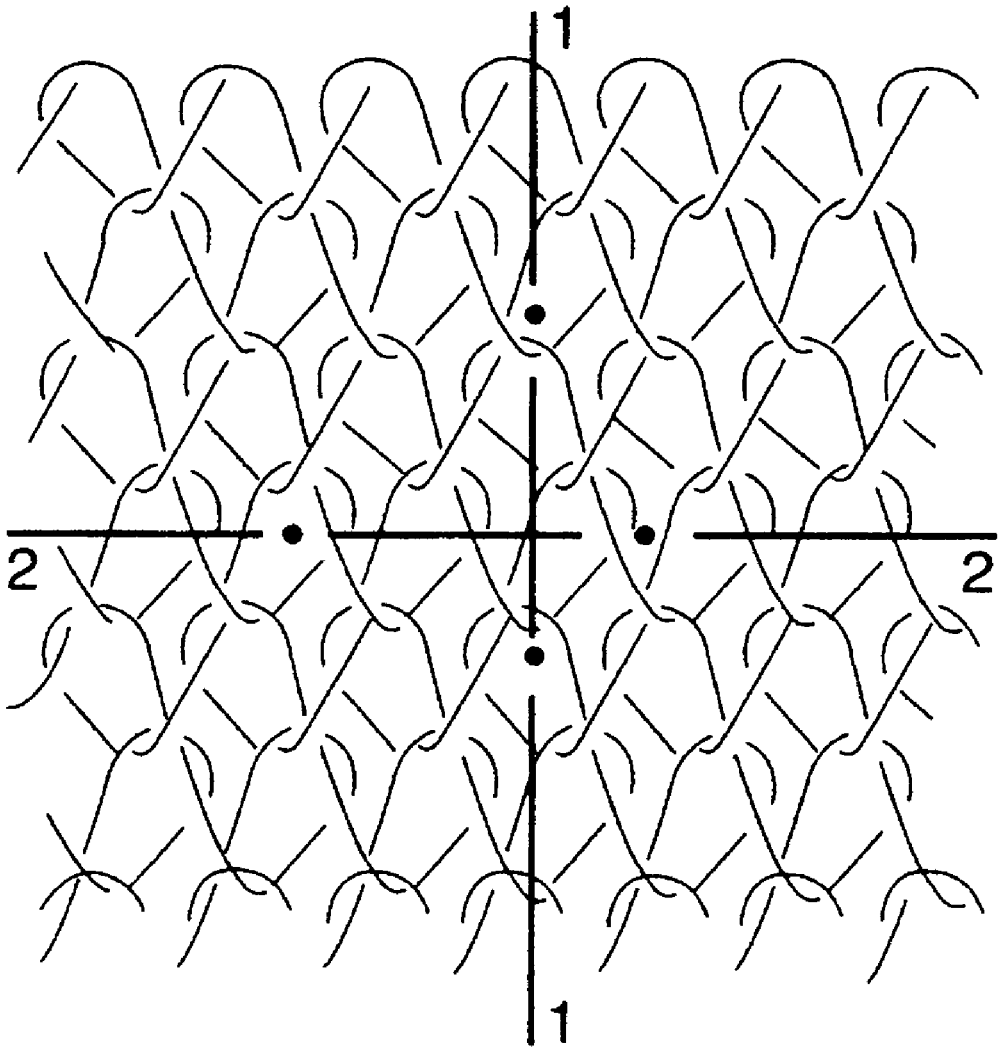
FIG. 1 is a schematic illustration of the construction of a warp-knitted fabric of the kind relating to the present invention, showing a multiplicity of needle loops arranged in wales and courses.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

We have now surprisingly discovered that the mechanical or physical properties, in particular the breaking strength and/or the tear strength, of a warp-knitted fabric used as a textile backing material for an adsorptive filtering material of the aforementioned kind, said warp-knitted fabric comprising a multiplicity of predominantly vertical columns of loops (wales), a multiplicity of predominantly horizontal rows of loops (courses) and a multiplicity of structural elements, can be significantly improved by some of the structural elements of the warp-knitted fabric being configured or arranged such that they each extend over a plurality of wales. In the case of such warp-knitted fabrics and in the case of adsorptive filtering materials and protective suits manufactured therewith, the breaking or tear strength is unexpectedly enhanceable over that of materials of the prior art by a distinct amount, for example by up to double.

The present invention accordingly provides, in a first aspect of the present invention, a process for improving the breaking strength and/or tear strength of a warp-knitted fabric, in particular for use in adsorptive filtering materials having a protective function against chemical poisons and/or warfare agent materials, the process comprising providing the warp-knitted fabric with a multiplicity of wales, a multiplicity of courses and a multiplicity of structural elements. The process of the present invention is characterized in that a portion of the structural elements of the warp-knitted fabric, in particular the floats, is configured and/or arranged to each extend over a plurality of wales; this specific measure of the present invention significantly improves the mechanical properties with regard to the breaking strength or tear strength of the warp-knitted fabric and thus of the adsorptive filtering material produced therewith.

For the purposes of the present invention, a warp-knitted fabric or warp knit is a knitted fabric constructed of at least one and preferably of a plurality of threads by warp knitting. Knitted fabrics are characterized in that, unlike woven fabrics, which consist of two thread systems ("warp and weft") crossing at right angles, they are produced by loop-forming operations. The central element or structural element of a knitted fabric and thus of a warp knitted fabric is the needle loop. The needle loop consists of a head, two limbs or legs and two feet. Knitted fabrics and in particular warp-knitted fabrics can be stretched not only lengthways but also widthways, in particular up to about 60% of the longitudinal extension. Knitted fabrics have the constant desire to return to their original position. As a result, knitted fabrics are conformable and have little tendency to wrinkle; in addition, their extensibility makes it possible for them to follow body movements, so that they have a high and pleasant wear comfort.

A warp-knitted fabric may comprise a multiplicity of threads or yarns which lie side by side and which, as in a woven fabric, run through the entire length of the fabric from the bottom to the top and interloop laterally to the right and left. The way one or more threads interloop or intermesh is known as the structure of the fabric.

Warp-knitted fabric can be produced according to the prior art from at least one thread, yarn or warp thread system. Each individual thread is guided by a guide needle in a guide bar. The guide needles of the guide bars lap (lay) the threads or to be more specific warp threads around so-called latch, bearded or compound needles. After the thread laying, needle loops are conjointly formed by the threading of the so-called needle bars on all needles to create a row (course) of loops. The guide bar is subsequently displaced (shogged) sideways around one or more needles. The threads are then laid again around the needles and a further course is formed. The shogging movement of the guide bar determines the form of the laying or lapping. The production of warp-knitted fabric is well known to one skilled in the art, so that further details in this regard need not be gone into here.

The different forms of the laying or lapping of threads can thus result in numerous structures for warp-knitted fabrics. These structures are termed loop constructions when they are constructed solely of the needle loop as structural element. These loops or loop structures, as will be discussed hereinafter, can be combined with each other and with other structural elements, such as inlay, filler thread, handle loop and float, thereby making it possible to endow the warp-knitted fabrics with certain and specific properties in each case. The basic structures of warp-knitted fabric include pillar, tricot, cord, satin, velvet and also atlas.

FIG. 1 is a schematic illustration of the construction of a warp-knitted fabric of the kind useful in the realm of the present invention, consisting of a multiplicity of needle loops arranged in wales and courses. The straight line running vertically in the 1-1 direction is a so-called wale, while the straight line going horizontally in the 2-2 direction is a so-called course of the warp-knitted fabric. In other words, the loops of the warp-knitted fabric which are arranged laterally next to each other, as it were, form a row or course while the loops arranged under and above each other form a column of loops, or course. Courses and wales are thus arranged at right angles to each other. Owing to the sheetlike nature of the warp-knitted fabric, the latter comprises a multiplicity of courses and wales.

The term "structural element" used herein refers to a specific arrangement or configuration of the thread in the warp-knitted fabric, due to a certain form of laying or lapping. The term "structural element" comprises for example the structural elements of inlay, filler thread, handle loop and float.

The term "breaking or tear strength" refers in particular to the tear propagation characteristics of a warp-knitted fabric, in particular of cuts, tears, notches or the like in a warp-knitted fabric, as they arise for example as a result of excessive mechanical loading, for example when protective suits are being worn. The higher the breaking or tear strength, the greater the force needed to cause tear propagation of the cut, tear or the like.

As used herein, the term "to extend" refers to a portion or section of the structural element or to a structural element as such of the warp-knitted fabric that runs without firm intermeshing, freely as it were, over a plurality of wales or over at least one wale. In other words, the portion of the structural element, i.e. of the corresponding thread section, thread, or the structure element as such, has no firm connection in the extending region with the corresponding wale, so that there is so to speak a free run across the corresponding wale in this location.

It may be provided in accordance with the present invention that the portion of the structural elements which extends over a plurality of wales is re-intermeshed or fixed on both sides in the wales adjoining the free region of extension, for example by forming a needle loop or the like. The adjoining wales constitute the starting and end point of the structural element extending over a plurality of wales. In other words, if for example the structural element extends over two wales, a total of four wales of the warp-knitted fabric will be involved in the formation of a structural element extending over the wales. This is because the particular adjacent wale is likewise involved in the formation of the structural element, as a starting or end point.

Figure 2:
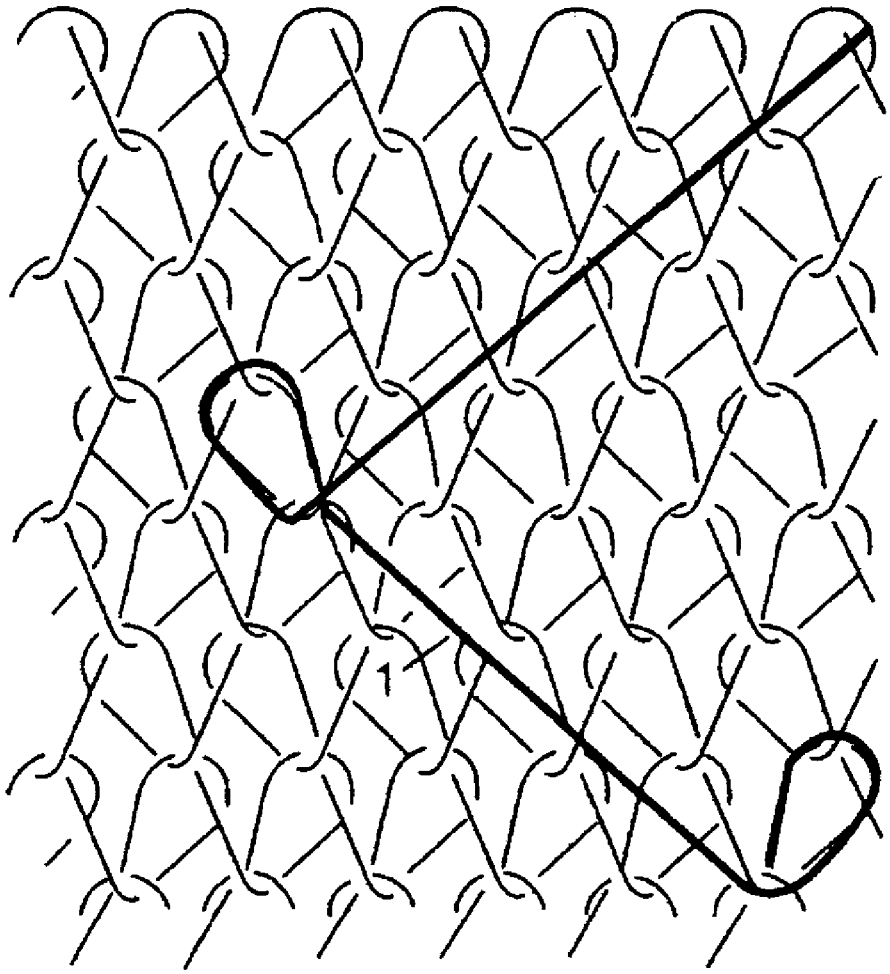
FIG. 2 is schematic illustration of a specific structural loop arrangement relating to the present invention.

This principle is illustrated in FIG. 2, according to which structural element portion 1, which extends over three wales in the present case, is limited on both sides by a wale in each case, in each of which the thread of the previously free structural element again forms a loop in each case.

With regard to the process of the present invention, the structural elements which extend over a plurality of wales improve the breaking strength or tear strength of the warp-knitted fabric, in particular at least essentially in the direction of the wales or at least essentially in the transverse direction of the courses. In other words, the warp-knitted fabric produced by the process of the present invention possesses in particular an enhanced breaking strength or tear strength along the wales, i.e. when a breaking or tearing force acts at least essentially parallel to the wales.

The process of the present invention thus leads to a warp-knitted fabric where the structural elements which each extend over a plurality of wales are pushed together or bundled when the warp-knitted fabric is exposed to a breaking or tearing stress or a breaking and tearing stress acts on the warp-knitted fabric; this effect is graphically described as a so-called "cable effect".

This is because applicant has completely surprisingly discovered that the breaking or tear strength of a warp-knitted fabric is significantly enhanced when a portion of the structural elements, in particular floats, each extends in the aforementioned sense over a plurality of wales. Without wishing to be tied down to any one specific theory, applicant has discovered that the significant enhancement of the breaking or tear strength is due to the "cable effect" described above, in that the threads or yarns of the structural elements which extend, so to speak run freely, over a plurality of wales under the action of a breaking or tearing force, for example under a tensile load, slide together to form a thread or yarn bundle in the tear triangle. This resulting cable effect decisively counteracts tear propagation and effects the significant improvement in the breaking or tear strength, since a yarn or thread bundle is formed that is better able to withstand a breaking force.

The structural elements which each extend over a plurality of wales can be in particular floats, handle loops and/or inlays in accordance with the present invention. In accordance with the present invention, the structural elements extending over a plurality of wales are preferably floats.

In accordance with the present invention, the structural element "handle loop" is a thread bow which can be chopped off the needle together with a needle stitch loop in the course of production and bound and held by the needle loop feet at the new needle loop. The handle loop may similarly extend in accordance with the present invention from the needle loop at which the thread is knocked off the needle to the new loop at which the thread is bound and held, in each case over a plurality of wales, in the aforementioned sense, i.e. without firm intermeshing.

"Inlay" in accordance with the present invention is a thread sector which is laid into the fabric at least essentially in transverse direction to the wales, i.e. parallel to the courses or perpendicularly to the wales, and can be held by other structural elements. The inlay may be a full inlay, which extends over the entire width of the warp-knitted fabric, or a partial inlay, which does not go through the entire width of the warp-knitted fabric. The inlay can be configured in the realm of the present invention such that it comprises thread sections which each extend over a plurality of wales in the aforementioned sense, i.e. without firm intermeshing with the wales.

In accordance with the present invention, the structural elements extending over a plurality of wales are, as already mentioned, floats. For the purposes of the present invention, a float is a limited thread or a limited thread sector or thread section which in the warp-knitted fabric extends in the sense of the present invention over at least one wale and may also extend over courses. In accordance with the present invention, the float within the warp-knitted fabric may be limited by needle loops, handle loops or inlays.

Figure 3A:
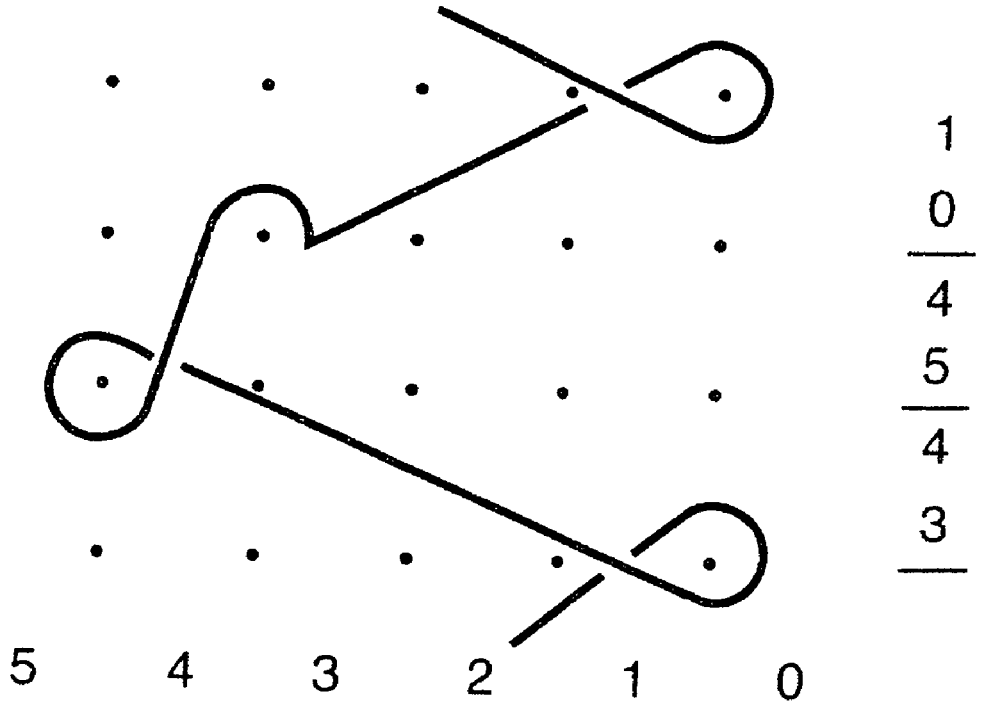
FIG. 3A is a graphic illustration of a lapping diagram relating to a thread formation.
Figure 3B:
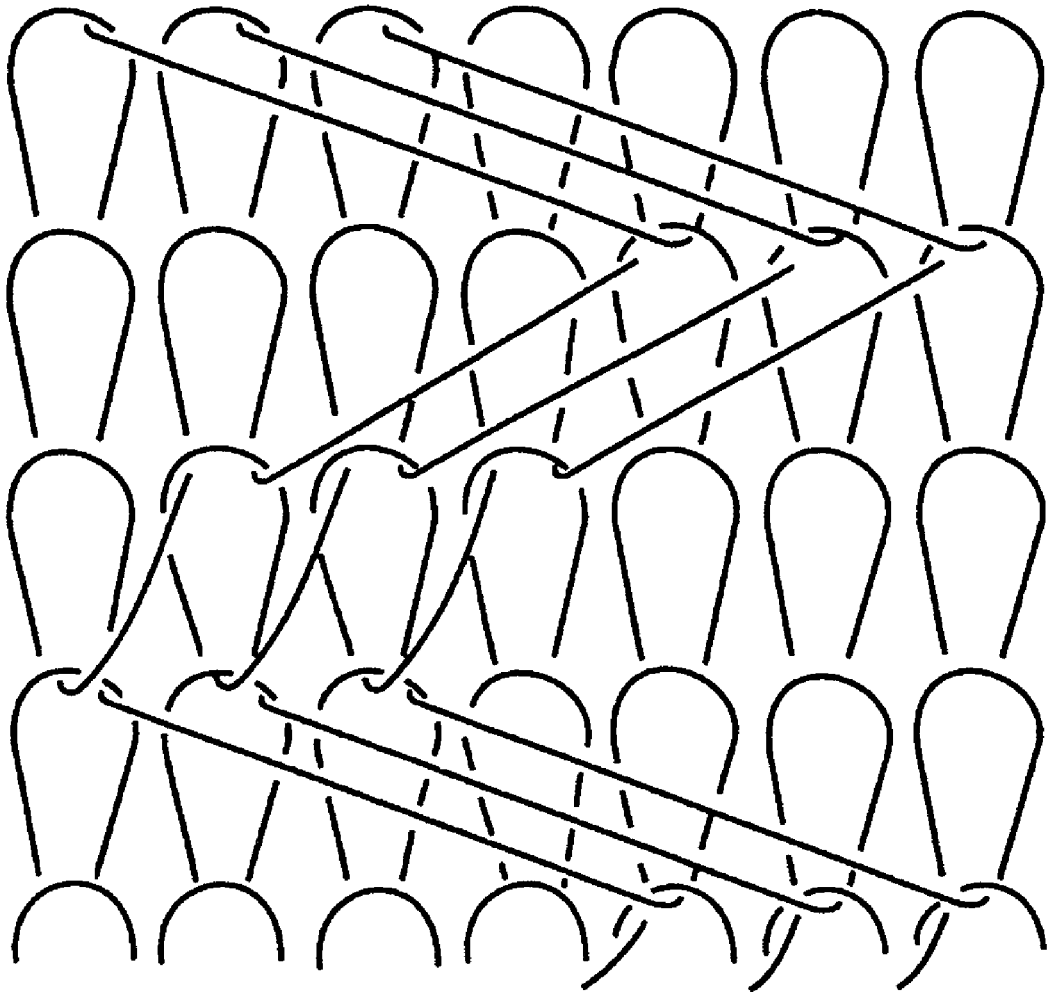
FIG. 3B is a schematic illustration of the stitch structure resulting from the FIG. 3A diagram.

Such floats as used in the realm of the process of the present invention are exemplarily and graphically illustrated in FIGS. 3A and 3B. FIG. 3A shows a lapping diagram in which the thread is lapped to obtain a float. The rows of dots represent the rows of needles of the warp-knitting machine, for example, used for production. The path of a guide needle, which is guided around the needle during the loop-forming operation, can be represented by means of the solid line. The numerals 0 to 5 indicated below the rows of dots identify the needle lanes positioned between the needles. The numerals on the left hand side of FIG. 3A indicate the course of the guide needle along the needle lanes. FIG. 3B shows the resulting stitch structure. FIG. 3B illustrates the principle of the floats preferably used in accordance with the present invention to enhance the breaking and tear strength of a warp-knitted fabric. According to the uppermost course and the bottommost complete course in FIG. 3B, the floats in one embodiment of the present invention extend over three wales, and also above one course, i.e. in total five wales are involved in relation to one such float. In relation to the second course from the top, the floats in a further embodiment of the present invention extend only over two wales, here too there is a displacement of one course; however, this is purely optional according to the present invention. The merely optional displacement in relation to courses makes it possible in accordance with the present invention to use even such floats as run obliquely or diagonally on the warp-knitted fabric. FIG. 3B similarly illustrates the principle of the present invention, whereby in the event of a breaking or tearing force appearing, the structural elements or floats running over the wales can be bundled in accordance with the cable effect described above, since they are not bonded to the needle loops or wales and thus lead to a stabilization of the warp-knitted fabric. The stabilization effect, i.e. the enhancement of the breaking or tear strength, increases with the number of wales which are "bridged" by the structural element or float.

It is thus preferable in accordance with the present invention that the structural elements, in particular floats, which each extend over a plurality of wales are configured or arranged to extend over at least two, in particular at least three and preferably at least four or more wales. This is because as the number of wales over which the structural elements or floats extend increases, the breaking or tearing force increases significantly—as previously described, and the warp-knitted fabric is increasingly stabilized. In accordance with the present invention, it can even be provided that the said structural elements or floats extend over up to five wales of the warp-knitted fabric.

It can similarly be provided in accordance with the present invention that the structural elements or floats which each extend over a plurality of wales are configured or arranged to extend over at least one course, as depicted in FIG. 3B. It is preferable, however, in accordance with the present invention to have in the plane of projection of the warp-knitted fabric an at least essentially parallel arrangement of the floats with regard to the wales or an at least essentially perpendicular arrangement with regard to the courses.

The structural elements, in particular the floats, each extending over a plurality of wales can be limited by other structural elements, for example needle loops, handle loops, inlays, filler threads and the like. Preferably, however, the said structural elements or floats are limited laterally by needle loops, preferably bilaterally, as depicted in FIG. 3B. The structural elements which limit the structural elements, in particular floats extending over a plurality of wales constitute in this respect the starting and end point of these free structural elements, in particular floats.

In other words, it may be provided in accordance with the present invention that the structural elements, in particular floats, which each extend over a plurality of wales are formed by a thread or thread sector or thread section which is free and/or continues and/or passes over the surface of the warp-knitted fabric without interlacing. In accordance with the present invention, the thread sector, synonymously also referred to as thread section or partial section of the thread, constitutes that portion of the thread which so to speak floats freely over the warp-knitted fabric. The portion of the thread not forming the free thread section can then be connected in the warp-knitted fabric to the warp-knitted fabric for example by means of further structural elements, in particular as described above.

It may be provided in accordance with the present invention that the thread which forms the structural elements, in particular floats, which each extend over a plurality of wales is an integral constituent of the warp-knitted fabric, for example by forming, in particular as previously described, needle loops of the warp-knitted fabric. It may also be provided that the thread is introduced into the warp-knitted fabric as independent or autonomous threads, for example in the form of an inlay.

The structural elements, in particular floats, each extending over a plurality of wales may in accordance with the present invention be formed from the same material as the rest of the warp-knitted fabric. But similarly it is also possible for the said structural elements, in particular floats, to be formed from a material other than the material of the rest of the warp-knitted fabric. For example, the structural elements, in particular floats, each extending over a plurality of wales may consist of or comprise cotton, polyester, polyamide or blends thereof. The threads may be flat or textured, and any texturing may be effected using chemical or physical methods known as such to one skilled in the art.

The breaking or tear strength of the warp-knitted fabric produced by the process of the present invention can be further improved or increased by additional measures, for example by using specific threads to form the structural elements or floats each extending over a plurality of wales; for instance, in the realm of the present invention, threads having a linear density in the range from 20 to 160 dtex, in particular in the range from 40 to 140 dtex, preferably in the range from 60 to 120 dtex and more preferably in the range from 80 to 100 dtex can be used. It is furthermore possible to use threads of high yarn strength, in particular high elongation at break. It is further possible to use threads of high elasticity. Applicant has surprisingly discovered that the breaking or tearing behavior of a warp-knitted fabric can be additionally affected by other factors or features of the textile fabric or of the warp-knitted fabric. For example, the construction of the warp-knitted fabric has an effect on the tear resistance, but also the finish of the warp-knitted fabric as such and the yarn construction likewise change the tear resistance. A greater number of threads per unit dimension or a finer yarn reduce the tear strength. Even the yarn type (for example staple fiber yarn) and the magnitude of the yarn twist can affect the tear behavior.

The warp-knitted fabric as such may in accordance with the present invention be any desired warp-knitted fabric. It is preferable according to the present invention for the warp-knitted fabric to have, in a nonlimiting manner, a stitch pattern of the type modified pillar, tricot, cord, satin, velvet or combinations thereof. Examples of useful combinations include a pillar with float or inlay or an atlas or locknit warp knit.

In general, specific layings or lappings of thread produce numerous warp-knitted structures, also known as needle loop structures because they are exclusively constructed of the structural element "needle loop". These needle loop structures may be combined with each other and with other structural elements (for example inlay, filler thread, handle loop, float).

A pillar stitch is a warp knit comprising wales without lateral connections. Lateral connections in a pillar stitch can be produced by inlays, floats and the like. It is only a combination of the wales with other structural elements which produces a textile fabric. A so-called "tricot warp knit" is obtained in accordance with the present invention when so-called underlaps of the pillar lapping are lengthened by one needle division. In other words, mutually adjacent wales are connected to each other in zigzag fashion so to speak. The tricot warp knit is extensible lengthways and widthways owing to the short lap and the open structure. In the case of the cord warp knit, its every loop-forming warp thread skips one wale or extends over one wale. In the case of the so-called "satin" warp knit, a portion of the structural elements extends over two wales. These binding properties endow "satin" lapping with a high transverse strength. The "velvet" warp knit is constructed such that a portion of the structural elements extends over three wales.

The aforementioned examples of warp-knitted fabric useful for the purposes of the present invention are purely illustrative and nonlimiting. This is because the present invention can utilize a huge multiplicity of various warp knits useful for forming structural elements each extending in the sense of the present invention over a plurality of wales in the manner of floats for example. This also includes the so-called "pillar/satin" lapping, which comprises a stable structure in the longitudinal and trans-verse directions due to a combination of pillar and satin.

In accordance with the present invention, the warp knit can be a warp knit based on open and/or closed loops. The warp knit used can be for example a plain, rib or purl construction. A plain construction has only reverse loops on one side and only face loops on the other side. A reverse loop side is characterized in that at the lower points of intermeshing the loop feet are above and the loop legs below the head of the preceding loops. By contrast, a face loop side is characterized in that at the lower points of intermeshing the feet are below and the legs above the head of the preceding loop. A rib structure has face loops on both sides of the fabric while the purl structure has predominantly reverse loops on both sides of the fabric.

The warp-knitted fabric may have an area weight in the range from 25 to 500 g/m$^2$, in particular in the range from 50 to 300 g/m$^2$ and preferably in the range from 75 to 200 g/m$^2$. A person skilled in the art is always able to adapt the area weights to the particular requirements.

The process of the present invention provides a significant enhancement in the breaking strength or tear strength of the warp-knitted fabric. The breaking strength or tear strength of a warp-knitted fabric which is being produced by the process of the present invention and in which a portion of the structural elements, in particular floats, each extends over two wales for example, is up by a factor of at least 1.1, in particular at least by a factor of 1.3 and preferably by a factor of 1.5 compared with the warp knitted fabric wherein the structural elements each extend over one wale at the most. Furthermore, in accordance with the process of the present invention, the breaking strength or tear strength of a warp-knitted fabric which has been produced by the process of the present invention in which a portion of the structural elements, in particular floats, each extends over three wales for example, is up by a factor of 1.6 at least, in particular by a factor of 1.8 at least and preferably by a factor of 2.0 at least, compared with the warp-knitted fabric wherein the structural elements are configured or arranged to each extend over one wale at most.

To construct an adsorptive filtering material, in particular to provide the warp-knitted fabric with an adsorbent, the warp-knitted fabric can be additionally provided with an adhesive, in particular an adhesive applied discontinuously and preferably dotwise, in particular for purposes of securing an adsorbent for chemical poisonous and warfare agent materials. The amount of adhesive applied should be less than 100 g/m$^2$, in particular less than 80 g/m$^2$, preferably less than 70 g/m$^2$, more preferably less than 60 g/m$^2$. It should be in general between 10 g/m$^2$ and 100 g/m$^2$ and in particular between 20 and 80 g/m$^2$, and more preferably the amount of adhesive applied is about 50 g/m$^2$. The adhesive can be applied for example in a regular pattern or grid, in particular, for example to a dot density of 25 mesh (113 dots/cm$^2$) to 40 mesh (289 dots/cm$^2$). For example, thickened polymeric dispersions, hotmelt adhesives or else reactive adhesives, in particular polyurethane-based one- and two-component systems, for example blocked prepolymer diisocyanates which crosslink via di- or polyfunctional amines or alcohols, can be used. Adhesives useful for the purposes of the present invention include for example such adhesives as are breathable in the cured state, for example polyolefin-based adhesives. The adhesive may be applied to the textile backing by rotary printing for example. The adhesive should preferably have been applied such that the structural elements extending over the wales are not significantly affected in their ability to float freely and of becoming bundled under breaking stress.

To construct an adsorptive filtering material which is in accordance with the present invention, it may additionally be provided that the warp-knitted fabric is additionally provided with an adsorbent for chemical poisonous and warfare agent materials, in particular with an adsorbent based on activated carbon. The adsorbent should be fixed to the warp-knitted fabric using an adhesive, in particular as previously described, in particular an adhesive applied discontinuously and preferably dotwise.

For an efficient adsorptive performance, preferably at least 50%, in particular at least 60% and preferably at least 70% of the textile fabric are provided with the adsorbent, in particular activated carbon, for poisonous and/or warfare agent materials. The adsorbent for poisonous and/or warfare agent materials should be at least 50%, in particular at least 60% and preferably at least 70% freely accessible for the poisonous and/or warfare agent materials to be adsorbed, i.e. should not be completely pressed into the adhesive.

The activated carbon preferably used as adsorbent for poisonous and/or warfare agent materials may consist for example of discrete particles of activated carbon, preferably in granule form ("granulocarbon") or spherical form ("spherocarbon"). In this case, the average diameter of the particles of activated carbon is in particular less than 1.0 mm, preferably less than 0.8 mm and more preferably less than 0.6 mm, but generally at least 0.1 mm. In accordance with this embodiment, the particles of activated carbon have been applied to the warp-knitted fabric in a loading amount which is advantageously in the range from 5 to 500 g/m$^2$, in particular in the range from 10 to 400 g/m$^2$, preferably in the range from 20 to 300 g/m$^2$, more preferably in the range from 25 to 250 g/m$^2$, even more preferably in the range from 50 to 150 g/m$^2$ and most preferably in the range from 50 to 100 g/m$^2$. Suitable particles of activated carbon have in particular an internal surface area (BET) of at least 800 m$^2$/g, in particular of at least 900 m$^2$/g and preferably of at least 1000 m$^2$/g, preferably in the range from 800 to 2500 m$^2$/g. Granulocarbon, in particular spherocarbon, has the decisive advantage that it is enormously abrasion resistance and very strong, which is very important with regard to the wear resistance properties. Preferably, the bursting pressure of an individual particle, in particular granule or spherule, of activated carbon is at least 5 newtons, in particular at least 10 newtons, and can be up to 20 newtons.

In an alternative embodiment, the warp-knitted fabric may be provided or invested with fibers of activated carbon, in particular in the form of an activated carbon fiber fabric. Such activated carbon fabrics may have for example an area weight in the range from 100 to 300 g/m$^2$, in particular in the range from 20 to 200 g/m$^2$ and preferably in the range from 30 to 150 g/m$^2$. The activated carbon fiber fabric may be for example a woven, loop-formingly knitted, laid or compound fabric of activated carbon fiber, in particular an activated carbon fiber fabric based on a carbonized and activated cellulose or on a carbonized and activated acrylonitrile. The activated carbon fiber fabric may be configured such that it leads to an additional enhancement of the breaking or tear strength of the warp-knitted fabric. It may be provided here that for example especially the breaking or tear strength in the longitudinal direction of the courses is stabilized.

To enhance the adsorptive efficiency or performance, it is possible for the adsorbent, in particular the activated carbon, to be provided or impregnated with at least one catalyst in a manner known to one skilled in the art. Catalysts useful for the purposes of the present invention include for example enzymes and/or metals, preferably copper, silver, cadmium, platinum, palladium, rhodium, zinc and/or mercury, in particular their ions and/or salts. The amount of catalyst can vary within wide limits; in general it is in the range from 0.05% to 12% by weight, preferably in the range from 1% to 10% by weight and more preferably in the range from 2% to 8% by weight, based on the weight of the adsorbent. The additional use of a catalyst takes some of the load of the activated carbon.

It may also be provided in accordance with the present invention that the adsorbent for chemical poisonous and/or warfare agent materials, in particular the material based on activated carbon, is provided, or covered, on that side which is remote from the warp-knitted fabric with an air-pervious textile material, in particular a textile fabric in the form of a batt, preferably a random batt, as covering layer. The batt, preferably the random batt, may be oriented in the direction of the wales of the warp-knitted fabric, so that the breaking strength or tear strength of the warp-knitted fabric is additionally improved, in particular at least essentially in the direction of the courses and/or at least essentially in the transverse direction of the wales. The orientation of the batt in the direction of the wales thus leads to a further improvement in the tear strength and supplements so to speak the enhanced breaking or tearing force resulting from the aforementioned measures, in the longitudinal direction of the wales. Owing to this synergistic mode of action between the oriented batt on the one hand and the warp-knitted fabric produced by means of the process of the present invention on the other, an extremely high breaking or tear strength is thus altogether achieved in total for the adsorption filter material according to the invention.

Owing to the investment of the warp-knitted fabric with an adsorbent and, in addition, with a covering fabric in particular a batt, a sandwich structure or compound thus results that is referred to as an adsorptive filtering material so to speak and that can be further processed into protective suits for example.

Figure 4:
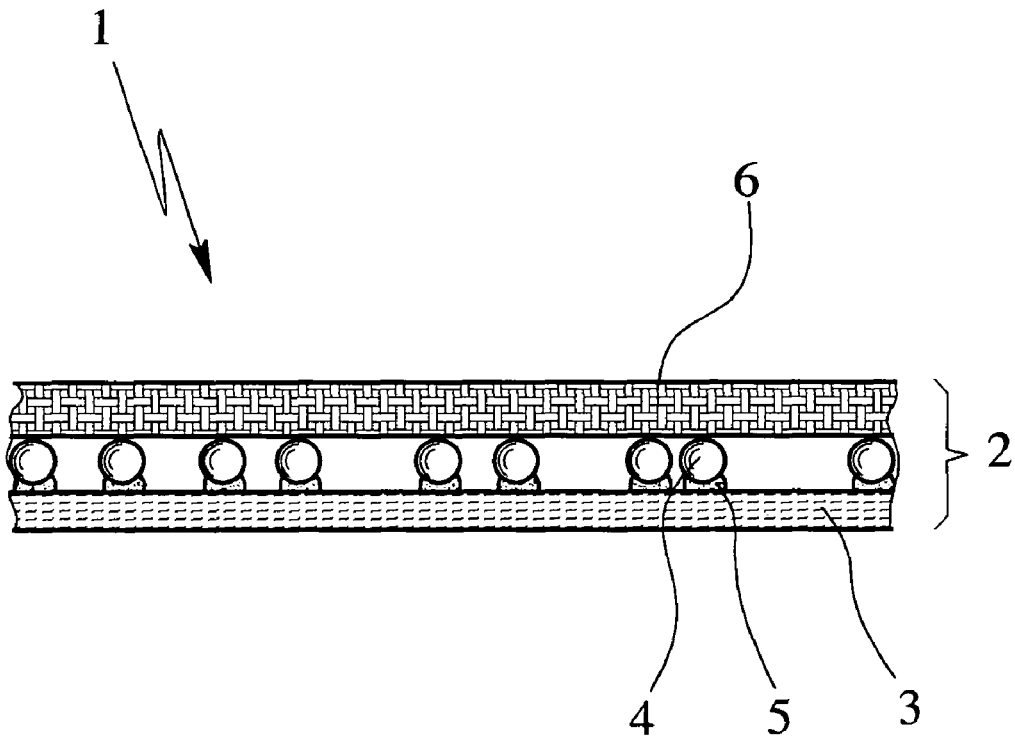
FIG. 4 is a side elevational view, in full section, of an adsorptive filtering material according to the present invention.

FIG. 4 illustrates the construction of the present invention's adsorptive filtering material 1, which is preferably configured as a compound 2. In this embodiment, the warp-knitted fabric 3 is additionally provided with a discontinuously and preferably dotwise applied adhesive 5 to which the activated carbon particles 4 in spherical form are applied. The present invention's adsorptive filtering material 1 further comprises, on that side of the adsorber 4 which is remote from the warp-knitted fabric, an air-pervious textile material 6 as a covering layer, which can be a batt for example.

The air-pervious textile material serving as a covering material for the adsorbent may be not only a batt but also a woven, loop-formingly knitted, loop-drawingly knitted, laid, bonded textile or other nonwoven fabric. The air-permeable textile material used as covering layer should have a lower area weight than the warp-knitted fabric, for example an area weight in the range from 5 to 75 g/m$^2$, in particular an area weight in the range from 10 to 50 g/m$^2$ and preferably an area weight in the range from 15 to 30 g/m$^2$.

More particularly, the present invention relates to a previously described process for improving the breaking strength or tear strength of a warp-knitted fabric, in particular for use in adsorptive filtering materials having a protective function against chemical poisons and/or warfare agent materials, the process comprising providing the warp-knitted fabric with a multiplicity of wales, a multiplicity of courses and a multiplicity of structural elements, a portion of the structural elements being formed as floats and at least a portion of these floats being configured or arranged such that the floats each extend over a plurality of wales, in particular over at least two wales.

The present invention further provides, in a second aspect of the present invention, the use of floats for improving the breaking strength or tear strength of a warp-knitted fabric comprising a multiplicity of wales and a multiplicity of courses, in particular for use in adsorptive filtering materials having a protective function against chemical poisonous and/or warfare agent materials. The present invention's use of the floats is characterized in that at least a portion of the floats is configured and/or arranged as to each extend over at least a plurality of, in particular over at least two, wales. For further details and observations concerning the use according the present invention, reference may be made to the above observations concerning the process of the present invention, which apply here mutatis mutandis.

The present invention finally further provides, in a third aspect of the present invention, an adsorptive filtering material having a protective function against chemical poisonous and/or warfare agent materials, in particular NBC warfare agents, the adsorptive filtering material comprising a sheet-like, in particular two-dimensional, textile backing material, the textile backing material is provided with an adsorbent for chemical poisonous and/or warfare agent materials, in particular NBC warfare agents, in particular an adsorbent based on activated carbon. It is a particular feature of the adsorptive filtering material according to the present invention that the textile backing material is configured as a warp-knitted fabric and that the warp-knitted fabric comprises a multiplicity of wales, a multiplicity of courses and a multiplicity of structural elements for improving the breaking strength or tear strength.

It may be provided in accordance with the present invention that a portion of the structural elements is configured or arranged to each extend over a plurality of wales, so that the breaking strength or tear strength of the warp-knitted fabric is improved, in particular at least essentially in the direction of the wales or at least essentially in the transverse direction of the courses. More particularly, in the event of a breaking stress on the warp-knitted fabric or the action of a breaking force, the structural elements, in particular floats, which each extend over a plurality of wales are pushed together or bundled, so that substantial stabilization results as a result by virtue of the "cable effect" described above.

In an embodiment which is preferred according to the present invention, the structural elements each extending over a plurality of wales are floats, handle loops and/or inlays. Preferably they are floats in accordance with the present invention.

It is preferably in accordance with the present invention that the structural elements, in particular floats, which each extend over a plurality of wales extend over at least two, in particular at least three and preferably at least four or more wales. For example, the said structural elements may also extend over five wales.

For further details and observations with regard to the adsorptive filtering material which is in accordance with the present invention, reference may be made to the above observations concerning the process of the present invention, which apply here mutatis mutandis.

The air perviousness of the adsorptive filtering material in accordance with the present invention should be—when measured to DIN 53887—more than 200 l/m$^2$ per second, preferably more than 300 l/m$^2$ per second, more preferably more than 400 l/m$^2$ per second, even more preferably more than 600 l/m$^2$ per second and most preferably more than 800 l/m$^2$ per second. High air perviousness is advantageous in particular in that it ensures a high wear comfort.

Similarly, the water vapor perviousness of the adsorptive filtering material according to the present invention leads to a high wear comfort. To ensure a high wear comfort, the adsorptive filtering material of the present invention may have, at 25° C., a water vapor transmission rate of at least 15 l/m$^2$ per 24 h, in particular 20 l/m$^2$ per 24 h, preferably at least 25 l/m$^2$ per 24 h, more preferably at least 30 l/m$^2$ per 24 h or even more (measured by the "Inverted Cup Method" of ASTM E 96 and at 25° C.) (for further details concerning the measurement of the water vapor transmission rate [WVTR] cf. also McCullough et al. "A comparison of standard methods for measuring water vapor permeability of fabrics" in *Meas. Sci. Technol. [Measurements Science and Technology]* 14, 1402-1408, August 2003). A particularly high wear comfort is ensured as a result, since perspiration can be removed effectively.

To ensure a high wear comfort, the adsorptive filtering material of the present invention may also have a water vapor transmission resistance RT under steady state conditions—measured according to DIN EN 31 092:1993 of February 1994 ("Textiles—Physiological Effects, Measurement of Heat and Water Vapor Transmission Resistance under Steady State Conditions (sweating guarded-hotplate test)") or according to the equivalent international standard ISO 11 092—at 35° C. of at most 20 ($m^2$·pascal)/watt, in particular at most 15 ($m^2$·pascal)/watt, preferably at most 10 ($m^2$·pascal)/watt and more preferably at most 5 ($m^2$·pascal)/watt.

The specific configuration of the adsorptive filtering material of the present invention thus ensures, as well as high wear comfort, an excellent protection against poisonous and noxiant materials, since the adsorptive filtering material of the present invention in particular prevents or at least delays the passage of gaseous poisons and noxiants. In addition, the mechanical stability, in particular the breaking or tear strength is significantly improved.

The adsorptive filtering material of the present invention, combining in particular a good protective effect against poisonous or noxiant agents with a high water vapor and air perviousness, provides a permeation resistance with regard to chemical warfare agents, in particular bis-[2-chloroethyl] sulphide (also known by the synonyms of mustard gas, Hd, Yellow Cross), measured according to CRDEC-SP-84010, method 2.2, allowing the passage of not more than 4 μg/$cm^2$ per 24 h, in particular not more than 3.5 μg/$cm^2$ per 24 h, preferably not more than 3.0 μg/$cm^2$ per 24 h and more preferably not more than 2.5 μg/$cm^2$ per 24 h. This makes it possible to achieve an extremely high protection against poisonous or warfare agents.

The adsorptive filtering material of the present invention also has the great advantage that it possesses an extremely high breaking or tear strength and hence is particularly suitable for use, for example, for protective suits and the like, in particular in military deployment, since it is highly able to withstand high stresses, in particular mechanical stresses. In addition, the adsorptive material of the present invention may be configured as an air pervious material, so that, as well as high protective performance against chemical poisonous and/or warfare agent materials and excellent mechanical stability, a high wear comfort can be achieved, which is an appreciable advantage in military deployment under extreme physical stress in particular.

Further advantages, elaborations, modifications, variations and properties of the present invention will become apparent and realizable by the ordinarily skilled after reading the description without their having to go outside the realm of the present invention.

The advantages of the process according to the present invention, of the use according to the present invention and also of the adsorptive material according to the present invention can be illustrated with reference to the following Examples:

EXAMPLES

The advantages of the present invention, in particular the significant improvement in breaking or tear strength, is illustrated using tear propagation tests, tear through tests and bursting tests. Tear propagation tests are carried out to assess the tear propagation behavior of incisions, for example in the course of making up, in a textile sheet. They are of specific importance particularly in relation to industrial textiles, but also in relation to the use of clothing. In the tear propagation test, the resistance of the incision to further tearing when an axial tensile stress is applied at the edges of the incision is determined.

In general, an adsorptive filtering material or a warp-knitted fabric has to pass various tests before being released for making up. An identical simulation of later loads is very important to obtain meaningful test results. The properties, in particular the high breaking and tear strength, of the present invention are determined using various experimental methods. These methods will now be briefly outlined:

Determination of Tear Force of Trouser-Shaped Test Specimens (Single Tear Method) in Accordance with DIN EN ISO 13937-2:2000

The trouser-shaped specimen tear test is primarily employed in the case of woven fabrics. But it can also be carried out on other single or multi plied textile fabrics where the incision propagates virtually in a straight line in the force direction along a thread, as is the case with the warp-knitted fabric used according to the present invention or with the adsorptive filtering material according to the present invention.

An incision is made in the narrow edge of a right angled test specimen to form two legs. The legs are clamped into clamping jaws of a constant rate of extension tensile tester with recording means such that the edges of the incision of the two legs form a straight line. They are then pulled apart in the direction of the incision such that the incision propagates through the test specimen. The tear-propagating force is recorded over a certain tear propagation path. The tear propagation force is determined from the force spike values of the recorded diagram or with computer support. To determine statistically sound values, two sets of specimens are taken from each sample, specifically one set in the direction of the wales (synonymously also referred to as "warp direction" or "warp") and the other in the direction of the courses (synonymously also referred to as "weft direction" or "weft"). The values reported in Table 2 are the mean values of the tear propagation force values determined in each case for the individual specimens. The tear propagation force is reported in newtons, separately according to "warp direction" and "weft direction".

Note the following for the results determined: when the "warp threads", or the threads of the wales, are broken, this is identified as tear propagation force "transverse to warp" or "transverse to wales". Correspondingly, when the "warp threads", or the threads of the courses, are broken, this is referred to as "transverse to weft" and "transverse to courses".

Determination of Tear Force Using Ballistic Pendulum Method (Elmendorf) in Accordance with DIN EN ISO 13937-1:2000

The method was initially developed specifically for testing the embrittlement of resin-finished cotton fabrics. In contrast to tear test methods, this method determines not the tear propagation force, but the dynamic load required to tear a woven fabric through at a previously made incision, as tear through force.

The force required to propagate an incision previously made in the textile fabric is determined by measuring the energy involved in the tear propagation of the textile fabric over a certain tear propagation path. The testing device consists of a pendulum equipped with a clamping jaw which is situated in the same plane as a second, fixed clamping jaw when the pendulum is in the raised starting position of maximum potential energy. A test specimen is clamped between the two clamping jaws and incised. The raised pendulum is released and the measuring sample is torn through when the mobile clamping jaw moves away from the fixed one. The tear propagation force is measured.

Specifically, the method is carried out as follows: sample taking is done as described above. The samples to be tested must not have creases, wrinkles, selvages or regions which are not representative for the fabric. A falling pendulum instrument is used to carry out the test. The falling pendulum instrument comprises a stable frame, the pendulum, a mechanical or electronic display means for the largest pendulum deflection on the first swing, the clamping jaw which is mobile and is part of the pendulum and the fixed clamping jaw, which is part of the frame, and also a sharp blade to be able to make an incision to a depth of (20±0.5) mm in the test specimen between the two clamping jaws. The apparatus finally comprises a means for cutting out the test specimens, such as a die cutter or a stencil. Each sample of the warp-knitted fabric or the adsorptive filtering material has two sets of specimens taken from it, one set in the "warp direction" or in the direction of the wales and the other set in the "weft direction" or in the direction of the courses. The short side of the test specimen is arranged exactly parallel to the "warp direction" or "weft direction" or parallel to the direction of the wales or courses in order that the rip runs to the notch opposite the incision. The test specimens have to be taken at a distance of at least 150 mm from the edge of the fabric. The test specimen is held between the two clamping jaws. The mobile clamping jaw is secured to the pendulum, which can free-fall. The test specimen has to be able to tear further without scuffing the pendulum. The tests are carried out by initially selecting the pendulum mass such that the readings are between 15 and 85% of the respective measuring range. The zero setting of the pendulum instrument has to be checked. The pendulum is raised into the starting position. The specimen is introduced into the clamping jaws such that its longitudinal edge is parallel to the upper jaw edge. It is clamped in the middle; the lower edge of the test specimen is carefully aligned relative to the lower clamp jaw end. The test specimen is incised with the blade at the side opposite the notch to a depth of (20±0.5) mm so as to leave a tear propagation knit of (43±0.5) mm. The pendulum is released by depressing a pendulum arrestor. On its return swing, the pendulum shall be stopped such that the pointer position is not changed. The tear propagation force in newtons is read off the measuring means to the nearest scale division marking or at the digital display. Check if the result is in fact between 15 and 85% of the measuring range employed. The test is repeated on a plurality of test specimens for each direction. It is necessary to observe whether the incision propagates in the force direction and the threads break instead of being pulled out of the textile fabric. A measurement is valid when a) no threads have been pulled out of the textile fabric and b) no slippage has occurred in the jaws and c) the test specimen is torn through and has torn in the region of the 15 mm wide notch. Other measurements shall be discarded.

The ballistic pendulum provides a direct measurement of the energy needed to tear through the specimen. It is generally preferable to report the force needed to tear through the specimen, which can typically be read off directly in newtons.

Pneumatic Method for Determination of Bursting Pressure and Bursting Distension According to DIN EN ISO 13938-2:1999

As well as parachute fabrics there are many other fabrics, particularly for use in industrial sectors, which should be subjected to a near-service and application-specific test according to the distending stress or according to the bursting pressure principle. The fact that the bursting test is used for knitted fabrics to determine their strengths almost exclusively is because many other test methods fail.

The principle of the pneumatic method for determination of bursting strength is that a test specimen is stretched tightly over an extensible membrane using a circular clamping ring. The side facing away from the test specimen has a continuously increasing air pressure applied to it to distend the membrane and the textile fabric. The pressure is raised at a uniform rate until the test specimen bursts. The bursting pressure and the bursting distension are determined.

Specifically, the method is carried out by first equilibrating the test specimen in the relaxed state to standard conditions before testing. The instrument is set to a test area of 50 $cm^2$. The control valve of the test instrument is adjusted so that the average bursting time is within (20±5) seconds. The bursting time is the time difference between the start of distension and the bursting of the test specimen. The test specimen is placed flat, without pre-tensioning and without deformation, on the membrane. The test specimen is securely clamped into the circular holder to prevent it slipping out during the test, care being taken to avoid any damage to the test specimen as it is being clamped into place. A distension-measuring device is brought into the measuring position and set to zero. A safety cover is secured in accordance with the instrument requirements. A pressure is exerted on the test specimen until the textile fabric bursts. The bursting measurement pressure and the bursting height are recorded. Bursting of the test specimen close to the edge of the clamping device must be noted; clamping breaks within 2 mm of the clamping line are to be discarded. The test is repeated several times on different places of the textile fabric.

To effect a membrane correction, the membrane without test specimen is distended by an amount equal to the average bursting height of the test specimen, while maintained in the same test area and setting of the control valve as in the above tests. The pressure at this membrane distension is to be noted as "membrane pressure".

The results are computed and reported by calculating the arithmetic mean value of the bursting measurement pressure in kPa. The membrane pressure in kPa is subtracted from that. The result is the bursting pressure.

Results:

The subsequent results obtained for tear strength were carried out for various test specimens using the methods described above. The experimental series reported in Tables 1 and 2 hereinbelow were intended to determine the influence of fabric construction on tear strength. Four polyester warp knits differing by virtue of different lapping movements in their constructions are adjusted for this purpose using the tear test on a trouser-shaped specimen with a single tear; the ballistic pendulum (Elmendorf) and the pneumatic method for determination of bursting pressure and bursting distension. Weight differences between the four polyester warp knits are due to their different constructions.

The specimens tested comprise a textile (backing) material based on a polyester warp knit. They differ in construction by virtue of the length of the "inlay" or the configuration or length of structural elements each extending over a plurality of wales. Accordingly, the number of wales over which the structural elements extend is different in the particular test specimens Ia, Ib, II and III (Table 1). The differing configuration of this "inlay" is caused in the production of the warp knitted fabric by the setting of guide bar 2 (specimens 1: 10/23=fairly short lapping (extension over one wale, "cord"); specimens II: 10/34=longer lapping (extension over two wales, "satin"); specimen III: 10/45=long lapping (extension over three wales, "velvet")). Specimens Ia and Ib ("cord") only differ in area weight.

Table 1 specifies the specimens investigated—namely the warp-knitted fabrics as such (specimens A, loomstate material), warp-knitted fabric with specific investment with an adhesive and loading with activated carbon (specimens B: intermediate material) and also warp-knitted fabric with adhesive, activated carbon and additional investment with a batt (specimens C: ready-produced material).

TABLE 1

| Article | Ia | Ib | II | III |
|---|---|---|---|---|
| Style | Warp knit (cord) | Warp knit (cord) | Warp knit (satin) | Warp knit (velvet) |
| Weight [g/cm$^2$] | ca. 59 | ca. 53 | ca. 61 | ca. 64 |
| Yarn 1 [dtex] | 33 flat | 33 flat | 33 flat | 33 flat |
| Yarn 2 [dtex] | 35 textured | 35 textured | 35 textured | 35 textured |
| Guide bar 1 | 01/10 | 01/10 | 01/10 | 01/10 |
| Guide bar 2 | 10/23 | 10/23 | 10/34 | 10/45 |
| Specimens A: loomstate [g/cm$^2$] | 59 | 53 | 61 | 64 |
| Adhesive add-on ca.[g/m$^2$] | 20 | 20 | 20 | 20 |
| Loading with activated carbon ca. [g/m$^2$] | 63 | 63 | 63 | 63 |
| Specimens B: intermediate ca. [g/cm$^2$] | 141 | 137 | 149 | 157 |
| Specimens C: ready produced ca. [g/m$^2$] | 186 | 183 | 190 | 192 |

Table 2 shows the results obtained for the breaking or tear behavior of the specimens using the methods described above. It is plainly evident in relation to the loomstate material (specimens A) and the ready-produced material (specimens C) that the breaking or tear strength, in particular in the direction of the wales "transverse to weft", i.e. along the wales or transverse to the weft direction, is significantly enhanced. But such an effect is also observable for the intermediate material (specimens C). In relation to the ready-produced material there is also a significant enhancement of the breaking or tear strength in the direction of the courses "transverse to warp", i.e. along the course or transverse to the "warp direction", indicating the additional stabilization of the ready-produced material due to the applied batt.

TABLE 2

| | Trouser tear test | | Ballistic pendulum (Elmendorf) | | Bursting pressure |
|---|---|---|---|---|---|
| | Warp [N] | Weft [N] | Warp [N] | Weft [N] | Pressure [kPa] |
| Loomstate A | | | | | |
| Ia | 5.55 | 6.26 | 4.38 | 4.48 | 190.11 |
| Ib | 5.84 | 6.39 | 5.73 | 4.63 | 210.73 |
| II | 5.13 | 10.04 | 3.59 | 6.96 | 239.03 |
| III | 6.14 | 13.56 | 4.64 | 9.45 | 281.57 |
| Intermediate B | | | | | |
| Ia | 6.41 | 7.03 | 3.88 | 3.41 | 187.18 |
| Ib | 6.82 | 6.50 | 3.87 | 3.52 | 197.87 |
| II | 5.65 | 8.94 | 3.51 | 5.16 | 259.91 |
| III | 6.22 | 11.25 | 3.73 | 5.86 | 280.98 |
| Ready produced C | | | | | |
| Ia | 10.46 | 7.61 | 9.07 | 4.35 | 230.48 |
| Ib | 10.22 | 7.22 | 8.75 | 3.51 | 215.52 |
| II | 9.71 | 10.09 | 12.24 | 6.44 | 282.97 |
| III | 10.23 | 11.11 | 9.12 | 7.36 | 302.78 |

The values reported in Table 2 are the highest loads determined in the course of the tests, at which a test specimen tears further, tears through and bursts, respectively.

Figure 5:
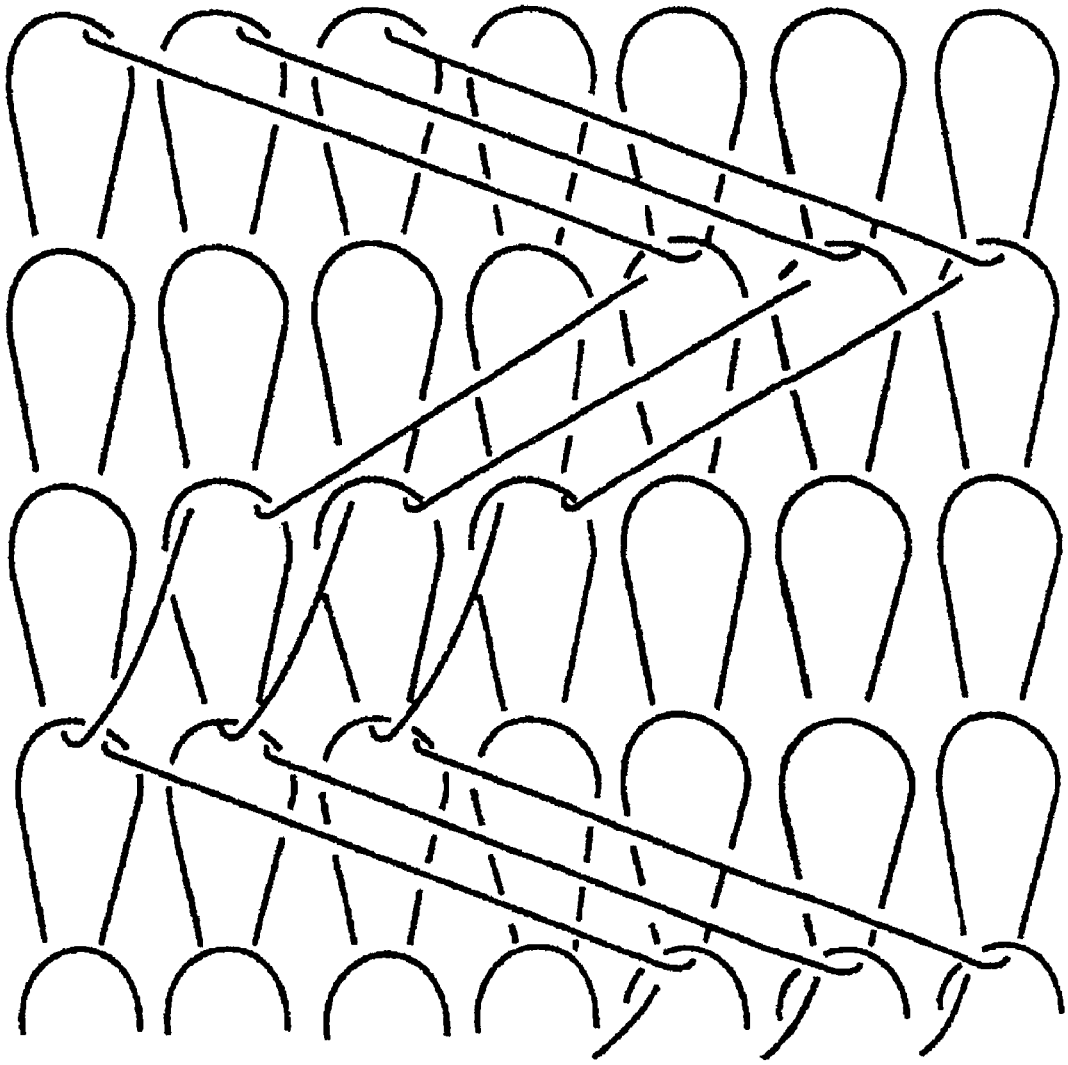
FIG. 5 is a schematic illustration of a stitch structure according to the present invention prior to application of a tear propagation force.
Figure 6:
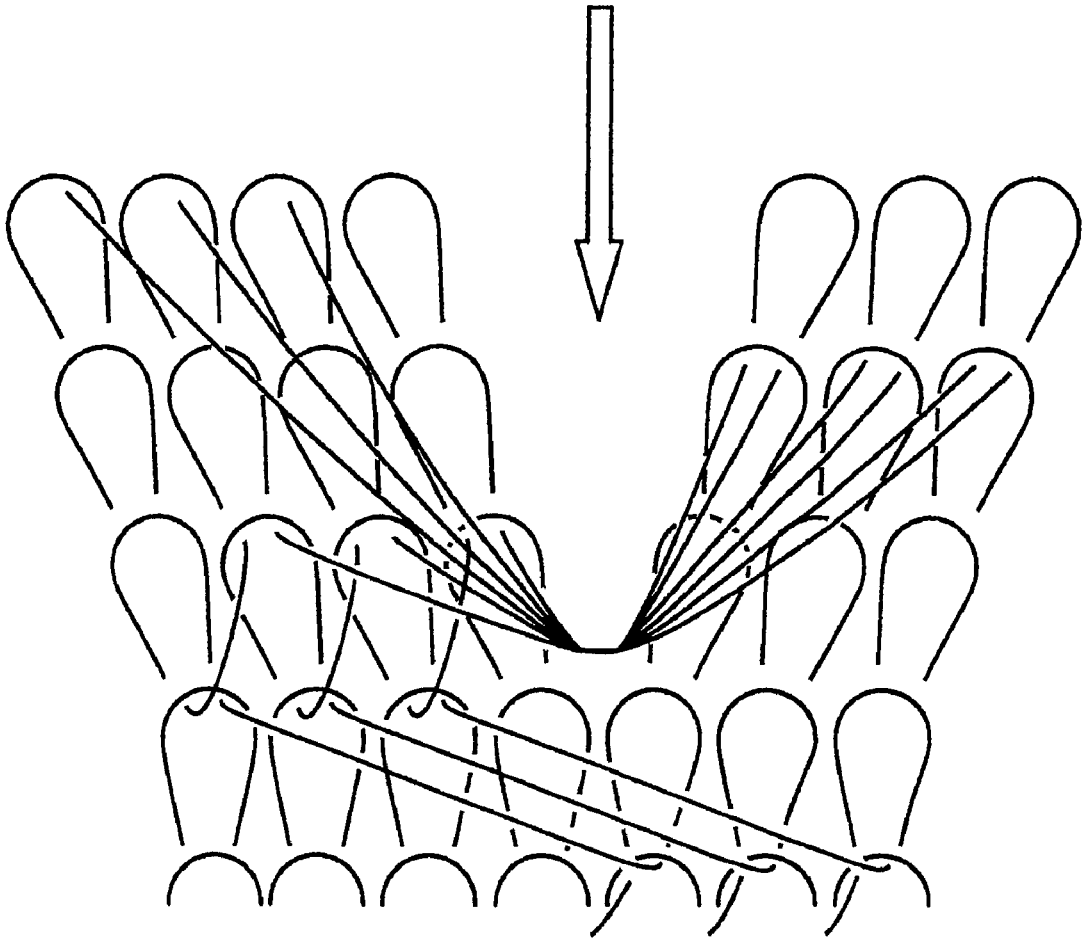
FIG. 6 is a schematic illustration of the FIG. 5 stitch structure after application of a tear propagation force showing the cable effect.

Without wishing to be tied down to any one theory, it is believed that the improved breaking or tear strength can be explained as follows: in the warp knits used in accordance with the process of the present invention, the individual yarns or threads coming for example under a tensile load (for example in the tear test on a trouser-shaped specimen) displace in the tear triangle to form a yarn bundle ("cable effect") . Refer to FIGS. 5 and 6 for the before and after illustrations. The arrow in FIG. 6 indicates the direction of the tear propagation force. The cable effect acts decisively against tear propagation and leads to improved tear strength.

Referring now to the bursting pressure results, there are scarcely any changes to be observed in going from the loomstate material (specimens A) to the intermediate material (specimens B). This is now and again due to the use of the hydrophobic polyester fiber, which does not suffer any fiber strength loss due to the applied adhesive, and due to the merely discontinuously applied adhesive, which does not significantly influence the "cable effect".

The results of the tear test on trouser-shaped specimens with a single tear show that the best results are in each case determined for the loomstate material (A III, "velvet"), the intermediate material (B III, "velvet") and the ready-produced material (C III, "velvet"). The materials build on each other and even the loomstate material (A III, "velvet") has the best tear strength by virtue of its construction. This is particularly clear in relation to the values transverse to weft.

The long lapping of the specimens A III, B III and C III, which runs over three wales, promotes displacement of the yarns in the tear triangle, for example under tensile load to form a yarn bundle. The resulting "cable effect" acts decisively against tear propagation and brings about the good results. The resulting intermediate and ready-produced materials also profit from this phenomenon. The dotwise application of adhesive has no significant influence on the strength of the hydrophobic polyester yarn. Only the lamination with the random batt brings a substantial increase in the "warp values" or the values in the direction of the courses. The reason for this is the "warp orientation" chosen for the batt, i.e. the orientation along the wales, which leads to the improvement in tear strength transverse to the wales ("warp"). In addition, a long lapping over three wales gives a high tear strength in the "weft". The reason for this is the "cable effect". The later lamination with the warp-oriented batt additionally strengthens the "warp", and a balanced textile adsorptive filtering material is obtained.

Considering the other loomstate materials A Ia ("cord"), A Ib ("cord") and A II ("satin"), it is seen that the results of A Ia and A Ib are almost identical. The two warp knits differ only in area weight, not in the lapping. This shows that the area weight has no significant influence on tearability, but mainly yarn strength, the thread count, the construction, the finish and also the incorporation and the number of interlacing points per unit length. As a result of loomstate material A II ("satin") which are in the middle, the lapping can be deduced as crucial factor. This is because it is longer than in the case of A Ia ("cord") and A Ib ("cord"), but shorter than in the case of A III ("velvet").

Considering the results of the ballistic pendulum (Elmendorf), it is clear that the loomstate material A III, the intermediate material B III and the ready-produced material C III provide the best "weft values". The good "warp values" in the case of the ready-produced material were, as mentioned above, achieved by the application of a batt.

The longer the "weft lapping", i.e. the larger the number of wales over which a portion of the structural elements, in particular floats, extends, the greater the number of threads which can be compressed or bundled to thus enhance the breaking or tear strength.

The correlation of lapping length and increased tear strength can be readily made out from the values for the figure reported in Table 1 for guide bar 2 and also from the "weft values" and burst values in Table 2.

Guide bar 1 indicates the "warp lapping", i.e. the lapping of the wales, and guide bar 2, the length of the "weft lapping", i.e. the lapping of the courses. The longer the "weft lapping", the greater the number of wales over which a portion of the structural elements, in particular the floats, extends and hence the better is the tear strength.

The lapping and in particular the configuration of the structural elements, in particular floats, extending over the wales thus have a decisive influence in warp knitted fabric production on the tear force values of the ready-produced materials. The reason for this is, as already mentioned, that the crucial factor in tear force testing is always how strong the particular unit undergoing tearing is. The unit undergoing tearing can be an individual yarn or thread or else a fiber bundle. The greater the number of possibilities for fiber bundling due to the lapping, the higher the tear force.

Fiber bundling can arise inter alia when a plurality of fibers or threads run parallel to each other. The tear force ratio of the warp-knitted fabric is optimized by the design of the warp-knitted fabric. Lapping and fiber linear density are decisive.

Applicant has surprisingly determined that the lappings or stitch patterns of the type cord (specimens Ia and Ib), satin (specimens II) and velvet (specimens III) produce in this order increasing tear force values in the transverse direction of the courses, i.e. in the longitudinal direction of the wales, not only for the loomstate material (specimens A) but also for the intermediate material (specimens B) and the ready-produced material (specimens C).

By optimizing the ratio of the particular tear force values in the longitudinal and trans-verse directions and by taking into account the covering material properties ("batt") and its orientation it is possible to achieve a further improvement in the tear force values of the ready-produced material, i.e. the adsorptive filtering material (i.e. warp knit as textile backing material, investment with adhesive, activated carbon and covering batt) as per specimens C.

In accordance with the present invention, this results in an adsorptive filtering material having excellent breaking or tear behavior not only in the direction of the wales but also in the direction of the courses.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. An adsorptive filtering material having a protective function against chemical agents, the adsorptive filtering material comprising:

a textile backing material, constructed and arranged as a warp-knitted fabric, said warp-knitted fabric having an area weight and including a plurality of wales, extending in a first direction, a plurality of courses, extending in a second direction, and a plurality of structural elements for improving the strength of the warp-knitted fabric;

wherein a portion of each structural element of said plurality of structural elements extends over at least two wales of said plurality of wales such that the strength of the warp-knitted fabric is increased in said first direction;

wherein in response to a stress force applied to the warp-knitted fabric, the plurality of structural elements that extend over said at least two wales are constructed and arranged for being bundled together, the plurality of structural elements being selected from the group consisting of floats, handle loops and inlays;

said textile backing material including an adsorbent for said chemical agents, said adsorbent having a composition based on activated carbon in the form of discrete particles;

said warp-knitted fabric further including a discontinuously and dotwise applied adhesive for securing the adsorbent wherein said discrete particles of activated carbon are secured to said dotwise adhesive such that at least fifty percent (50%) of the surface area of each discrete particle is not contacted by said dotwise adhesive and is freely accessible for said chemical agents to be adsorbed, wherein the amount of applied adhesive is less than 100 g/m$^2$, wherein said adhesive is applied to said warp-knitted fabric such that the plurality of structural elements extending over said at least two wales retain an ability to float and to become bundled together; and an air-pervious textile material layer having an area weight, said adsorbent being positioned between said air-pervious textile material layer and said textile backing material, wherein the area weight of said air-pervious textile material layer is lower than the area weight of said warp-knitted fabric.

2. The adsorptive filtering material according to claim 1, wherein the plurality of structural elements which each extend over at least two wales are floats.

3. The adsorptive filtering material according to claim 1, wherein the plurality of structural elements which each extend over said at least two wales are formed by a thread which passes over the surface of the warp-knitted fabric without interlacing.

4. The adsorptive filtering material according to claim 1, wherein the warp-knitted fabric used is a warp-knitted fabric based on open or closed loops and wherein the warp-knitted fabric used is selected from the group consisting of plain, rib and purl fabrics.

5. An adsorptive filtering material having a protective function against chemical agents, the adsorptive filtering material comprising:

a textile backing material, constructed and arranged as a warp-knitted fabric, said warp-knitted fabric including a plurality of wales, extending in a first direction, a plurality of courses, extending in a second direction, and a plurality of structural elements for improving the strength of the warp-knitted fabric;

wherein a portion of each structural element of said plurality of structural elements extends over at least two wales of said plurality of wales and wherein each structural element is integrated into said warp-knitted fabric by a formed loop such that the strength of the warp-knitted fabric is increased in said first direction;

wherein in response to a stress force applied to the warp-knitted fabric, the plurality of structural elements that extend over said at least two wales are constructed and arranged for being bundled together;

said textile backing material including an adsorbent for said chemical agents, said adsorbent having a composition based on activated carbon in the form of discrete particles; and said warp-knitted fabric further including a discontinuously and dotwise applied adhesive for securing the adsorbent wherein said discrete particles of activated carbon are secured to said dotwise adhesive such that at least fifty percent (50%) of the surface area of each discrete particle is not contacted by said dotwise adhesive and is freely accessible for said chemical agents to be adsorbed, wherein the amount of applied adhesive is less than 100 $g/m^2$ and wherein said adhesive is applied to said warp-knitted fabric such that the plurality of structural elements extending over said at least two wales retain an ability to float and to become bundled together.

6. An adsorptive filtering material having a protective function against chemical agents, the adsorptive filtering material comprising:

a textile backing material, constructed and arranged as a warp-knitted fabric, said warp-knitted fabric having an area weight and including a plurality of wales, extending in a first direction, a plurality of courses, extending in a second direction, and a plurality of structural elements for improving the strength of the warp-knitted fabric;

wherein a portion of each structural element of said plurality of structural elements extends over at least two wales of said plurality of wales such that the strength of the warp-knitted fabric is increased in said first direction;

wherein in response to a stress force applied to the warp-knitted fabric, the plurality of structural elements that extend over said at least two wales are constructed and arranged for being bundled together, the plurality of structural elements being selected from the group consisting of floats, handle loops and inlays;

said textile backing material including an adsorbent for said chemical agents, said adsorbent having a composition based on activated carbon in the form of discrete particles;

said warp-knitted fabric further including a discontinuously and dotwise applied adhesive for securing the adsorbent wherein said discrete particles of activated carbon are secured to said dotwise adhesive such that at least fifty percent (50%) of the surface area of each discrete particle is not contacted by said dotwise adhesive and is freely accessible for said chemical agents to be adsorbed, wherein the amount of applied adhesive is less than 100 $g/m^2$, wherein said adhesive is applied to said warp-knitted fabric such that the plurality of structural elements extending over said at least two wales retain an ability to float and to become bundled together; and an air-pervious textile material layer having an area weight, said adsorbent being positioned between said air-pervious textile material layer and said textile backing material, wherein the area weight of said air-pervious textile material layer is lower than the area weight of said warp-knitted fabric and wherein the air-pervious textile material is in the form of a batt, the batt being oriented in the direction of the wales of the warp-knitted fabric.

* * * * *